US005413770A

United States Patent [19]

Sakaguchi et al.

[11] Patent Number: 5,413,770

[45] Date of Patent: May 9, 1995

[54] STIRRING APPARATUS FOR AN AUTOMATIC CHEMICAL ANALYSIS SYSTEM

[75] Inventors: Soichiro Sakaguchi; Makoto Ishizaki, both of Nishinasuno, Japan

[73] Assignee: Kabushiki Kaisha Toshiba, Kawasaki, Japan

[21] Appl. No.: 105,066

[22] Filed: Aug. 12, 1993

[30] Foreign Application Priority Data

Aug. 12, 1992 [JP] Japan ..... 4-215101

[51] Int. Cl.[6] ..... B01F 11/00; B01F 11/04

[52] U.S. Cl. ..... 422/225; 366/118; 366/127

[58] Field of Search ..... 422/63, 65, 64, 67, 422/99, 224, 225; 366/116, 118, 119, 120, 127

[56] References Cited

U.S. PATENT DOCUMENTS

| | | | |
|---|---|---|---|
| 4,052,161 | 10/1977 | Atwood et al. | 422/81 X |
| 4,224,278 | 9/1980 | Hogenesch | 422/65 |
| 4,341,736 | 7/1982 | Drbal et al. | 422/100 |
| 4,344,768 | 8/1982 | Parker et al. | 422/72 X |
| 4,612,291 | 9/1986 | Dawes | 436/174 |
| 4,731,225 | 3/1988 | Wakatake | 422/67 X |
| 4,774,055 | 9/1988 | Wakatake et al. | 422/63 X |
| 4,788,141 | 11/1988 | Yamasaki et al. | 422/64 X |
| 4,861,553 | 8/1989 | Mawhirt et al. | 422/65 |
| 4,908,320 | 3/1990 | Zakowski et al. | 422/64 X |
| 4,919,887 | 4/1990 | Wakatake | 422/64 X |
| 4,965,049 | 10/1990 | Lillig et al. | 422/64 X |
| 45,046,515 | 9/1977 | de Leeuw | 366/117 X |

*Primary Examiner*—Robert J. Warden
*Assistant Examiner*—Robert Carpenter
*Attorney, Agent, or Firm*—Oblon, Spivak, McClelland, Maier, & Neustadt

[57] ABSTRACT

A stirring apparatus for an automatic chemical analysis system for analyzing a sample in a reaction vessel for obtaining an amount of a specific component of the sample. The stirring apparatus includes a stirring member formed as a vibrating member of a piezoelectric vibrator and having a flexible structure in the shape of an elongated strip or plate, a support unit for holding the stirring member in a perpendicularly suspended manner, a moving unit for moving the support unit together with the stirring member between the reaction vessel and a washing unit for washing the stirring member, a vibrating unit for vibrating the stirring member in a washing pool of the washing unit and in the reaction vessel and a control unit operatively connected to these units, respectively, for controlling operations of the respective units. The moving unit includes a waiting time setting element for setting a predetermined waiting time between the movement of the stirring member from the vertical and horizontal movements thereof.

7 Claims, 7 Drawing Sheets

STIRRING APPARATUS FOR AN AUTOMATIC CHEMICAL ANALYSIS SYSTEM

BACKGROUND OF THE INVENTION

1. Field of the Invention

The present invention relates to an automatic chemical analysis system for obtaining an amount of a specific component of, for example, a sample material in chemical and biochemical fields, and more particularly, to a stirring apparatus utilized for the automatic chemical analysis system for stirring liquid sample material and reagent.

2. Discussion of the Background

An automatic chemical analysis system is a system in which a liquid sample material, called merely the sample hereinbelow, and a reagent, each of a predetermined amount, are supplied in a reaction vessel in which the sample and the reagent are stirred to mix them together as a sample solution or reaction solution. The process of a chemical reaction due to this stirring is measured by means of, for example, an optical measuring device, through detection of change of an absorbance to thereby obtain an amount of a specific component in the sample.

Such an automatic chemical analysis system is provided with a stirring apparatus for stirring and mixing the sample and the reagent together to homogenize its reaction solution, and such stirring is an important process for reproducibility of the reaction. The stirring apparatus generally comprises a stirring member for stirring the sample and the reagent in the reaction vessel, a support mechanism for holding the stirring member, a washing and/or cleaning mechanism for washing the stirring member with a washing water to remove the sample and reagent adhering to the surface of the stirring member and a mechanism for moving the stirring member support mechanism between the washing mechanism and the reaction vessel. In the chemical analysis system, the movement of the stirring member to the reaction vessel, the stirring operation, the movement thereof to the washing mechanism and the washing operation are repeated for the process carried out by the stirring apparatus.

In one example of a known type of stirring apparatus, a screw type stirring member or a plate-like stirring member, which is driven by an electric motor for stirring, is utilized. In another example of a known type stirring apparatus, a bimorf type piezoelectric vibrator formed by bonding piezoelectric elements to both sides of a thin metal plate is utilized as an example which is not driven by an electric motor (for example, as disclosed in U.S. Pat. No. 4,612,291). In this known type of apparatus, a stirring plate or rod formed of a rigid material such as stainless steel is attached to the thin metal plate, and when an A.C voltage is applied thereto, the vibration of the piezoelectric vibrator is transferred to the stirring plate, thus stirring the sample solution.

However, the known stirring member driven by the motor in one of the above examples has less stirring ability in the vertical direction in the reaction vessel, so that the stirring of the sample solution is not sufficiently carried out in the bottom portion and an upper portion of the reaction vessel and involves relatively a great amount of time for the stirring. In order to obviate these defects, when the motor is forcibly driven to increase its revolution, bubbling is caused or air bubbles are involved, and hence, there may occur cases where the sample solution overflows or is splashed from the reaction vessel.

On the other hand, in the known stirring mechanism of another example utilizing the piezoelectric vibrator, in a certain case, the stirring plate is positioned so that the width direction of the stirring plate attached to the front end of the piezoelectric vibrator has an angle, for example 90°, with respect to the moving direction of the stirring plate (tangential direction in a case of arcuate movement). In such case, since the vibrating direction, i.e. thickness direction normal to the width direction, and the moving direction of the agitating plate are in accord with each other, the stirring plate may be greatly vibrated due to an inertia force, for example. Particularly, this vibration will be remarkable when the stirring plate is continuously moved in horizontal and vertical directions. For this reason, for example, when the stirring plate is lowered into the reaction vessel for stirring, there is a fear of colliding of the stirring plate with the edge portion of the reaction vessel, resulting in breakage or bending thereof in an adverse case, and moreover, the reaction solution adhering to the stirring plate and the washing liquid may be splashed due to such vibration during the movement of the stirring plate.

Furthermore, at the time of washing the stirring plate, the washing liquid adheres to the surface of the stirring plate, but in the described known example, the washed stirring plate is utilized as it is for the next stirring, so that there is a fear of diluting the sample solution and hence obtaining inaccurate data, thus being inconvenient.

SUMMARY OF THE INVENTION

A primary object of the present invention is to substantially eliminate defects or drawbacks encountered in the prior art and to provide an automatic chemical analysis system provided with a stirring apparatus capable of reducing the stirring time and surely removing washing liquid adhering to the stirring member so as not to be included in a solution to be treated or measured.

Another object of the present invention is to provide an automatic chemical analysis system provided with a stirring apparatus capable of suppressing vibrations during the movement or transfer of the stirring member to thereby prevent it from colliding with another equipment and capable of preventing the washing liquid and solution to be treated from splashing during the movement of the stirring member.

These and other objects can be achieved according to the present invention by providing an automatic chemical analysis system for analyzing a sample in a reaction vessel for obtaining an amount of a specific component of the sample, the automatic chemical analysis system including a stirring apparatus for stirring the sample with a reagent in the reaction vessel, the stirring apparatus comprising:

- a stirring member having a flexible structure;
- a support means for holding the stirring member in a perpendicularly suspended manner;
- a moving means for moving the support means together with the stirring member between the reaction vessel and a washing pool for washing the stirring member;
- a washing means including the washing pool for washing the stirring member;

a vibrating means for vibrating the stirring member in the washing pool and in the reaction vessel and;

a control means operatively connected to these means, respectively, for controlling operations of the respective means.

In preferred embodiments, the stirring member has an elongated strip or plate member having surfaces and the vibrating means vibrates the stirring member in a direction opposing the surfaces of the stirring member.

The stirring member is composed of a vibrating member of a piezoelectric vibrator. The support means is a cylindrical holder having an inner hollow portion in which the piezoelectric vibrator is accommodated. The piezoelectric vibrator comprises a flexible metallic shim and a piezoelectric ceramics bonded to a surface of the metallic shim. The stirring member has a width direction parallel to a moving direction or a tangential direction of the stirring member moved by the moving means.

The moving means includes a first drive means for moving vertically the stirring member and a second drive means for moving horizontally the stirring member.

The moving means includes a waiting time setting means for setting a predetermined waiting time between the movement of the stirring member from the vertical and horizontal movements thereof.

The control means includes a central processing unit, a driving unit connected to the central control unit and a vibration controlling unit connected to the central processing unit, the driving unit being operatively connected to the moving means and the vibration controlling unit being operatively connected to the stirring member.

According to the structures and characters of the present invention described above, when the vibrating member is operated during the stirring time under the condition that the stirring member is lowered into the reaction vessel, the stirring member is vibrated periodically in a direction opposing to the surface of the stirring member, thus achieving the improved stirring condition in the vertical direction in the reaction vessel. After the completion of the stirring, the stirring member is transferred to the washing pool by the moving means and washed therein by the washing mechanism. When the washing process has been completed, the vibrating means is operated to vibrate the stirring member. Accordingly, the stirring member is vibrated during the vertical upward movement in the washing pool and at the waiting position above the washing pool for the next motion, that is the movement in the upper space of the pool, thus shaking off the drops of the washing liquid adhering to the stirring member after the washing in the washing pool.

The vibrating frequency and the oscillation width of the stirring member, where the stirring member is constructed by an oscillation member of the piezoelectric vibrator, can be easily adjusted, thus suppressing the generation of bubbles of the solution.

Since the stirring member is supported in a state that the width direction thereof accords with its moving direction or tangential direction, the stirring member provides high rigidity with respect to its motion in the moving direction or tangential direction in the case of arcuate movement. Accordingly, the vibration of the stirring member due to the inertia force during the movement between the washing pool and the reaction vessel can be minimized and the splashing of the washing liquid and the solution adhering to the stirring member during the movement can be also reduced.

When the support mechanism is moved by the moving means, a constant waiting time is set during the horizontal movement and the vertical movement by the waiting time setting means of the moving means. Accordingly, even if a slight vibration be caused during the movement, the vibration is converged during this waiting time, thus the stirring member is prevented from colliding with another equipment during its movement for the next process.

The nature and further features of the present invention will be made more clear from the following descriptions by way of preferred embodiment with reference to the accompanying drawings.

DESCRIPTION OF THE PREFERRED EMBODIMENTS

An automatic chemical analysis system generally comprises an analyzing unit and a data processing unit. The analyzing unit includes a sampler generally having a circular configuration and being rotatable, in which a plurality of sample vessels are set, a reagent setting means for supplying a reagent and a measuring and analyzing unit including a constant temperature and a stirring means, for example. In such the analysis system, these units or means are arranged on a table, for example, of the analyzing unit. A washing means is also disposed in the vicinity of the sample analyzing unit. The data processing units includes an overall control unit such as central processing unit provided with a display means or a printer. The data from or to the respective means are controlled by this central processing unit.

The sample and reagent are supplied in a reaction vessel, which are then agitated and mixed together for the measurement.

Figure 10:
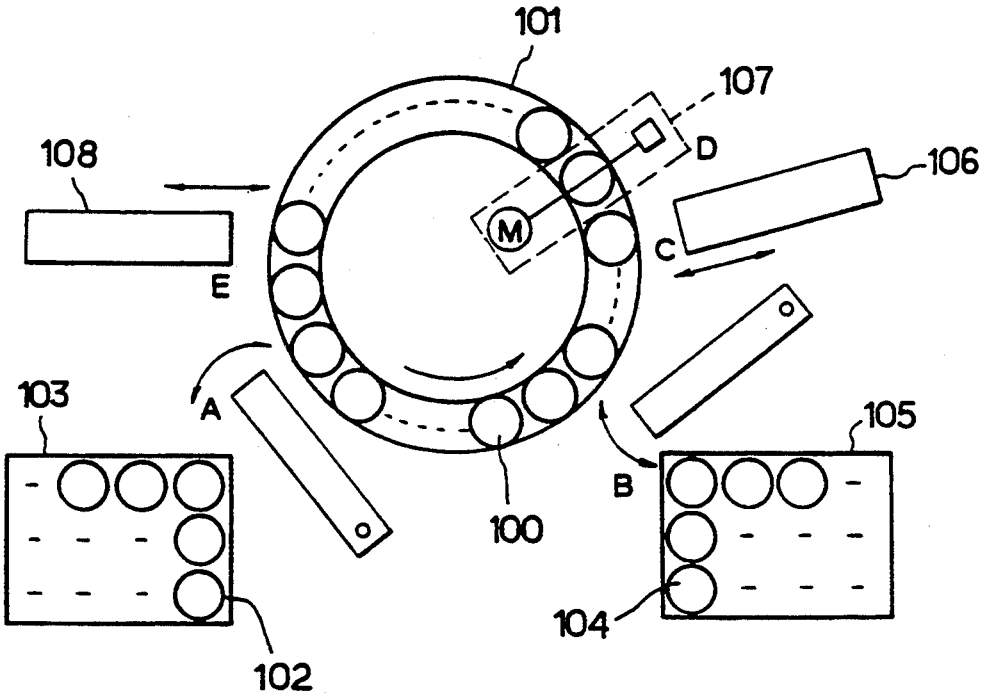
FIG. 10 is a schematic view showing the entire arrangement of an automatic chemical analysis system of one example to which the present invention is applicable.

First, a basic arrangement of one example of such automatic chemical analysis system is illustrated in FIG. 10 to which the present invention is applicable.

Referring to FIG. 10, a plurality of reaction vessels 100 are disposed, for example, in a circular constant temperature container 101 and intermittently moved in an arrowed direction by a driving means at a predetermined cycle.

A sampler 103 in which a plurality of sample vessels 102 each containing a sample to be analyzed, is disposed at a position A around the container 101 and any arbitrary sample can be sucked and supplied to one of the reaction vessels 100. Further, a reagent storage unit 105, in which a plurality of reagent vessels 104 each containing a reagent to be reacted with a sample for analyzing the specific component, is disposed at a position B and any arbitrary reagent can be sucked and supplied to the reaction vessel 100.

Similarly, a stirring unit 106 for stirring a reacted solution in the reaction vessel 100 is disposed at a position C, for example, a measurement unit 107 for measuring a reacted solution in the reaction vessel 100 is disposed at a position D, and a washing unit 108 for washing the reaction vessel 100 to which a measurement has been carried out is disposed at a position E.

The automatic chemical analysis system of the structure described above is so-called a random access type analysis system as one example, and another type may be the one applicable to the present invention.

Figure 1:
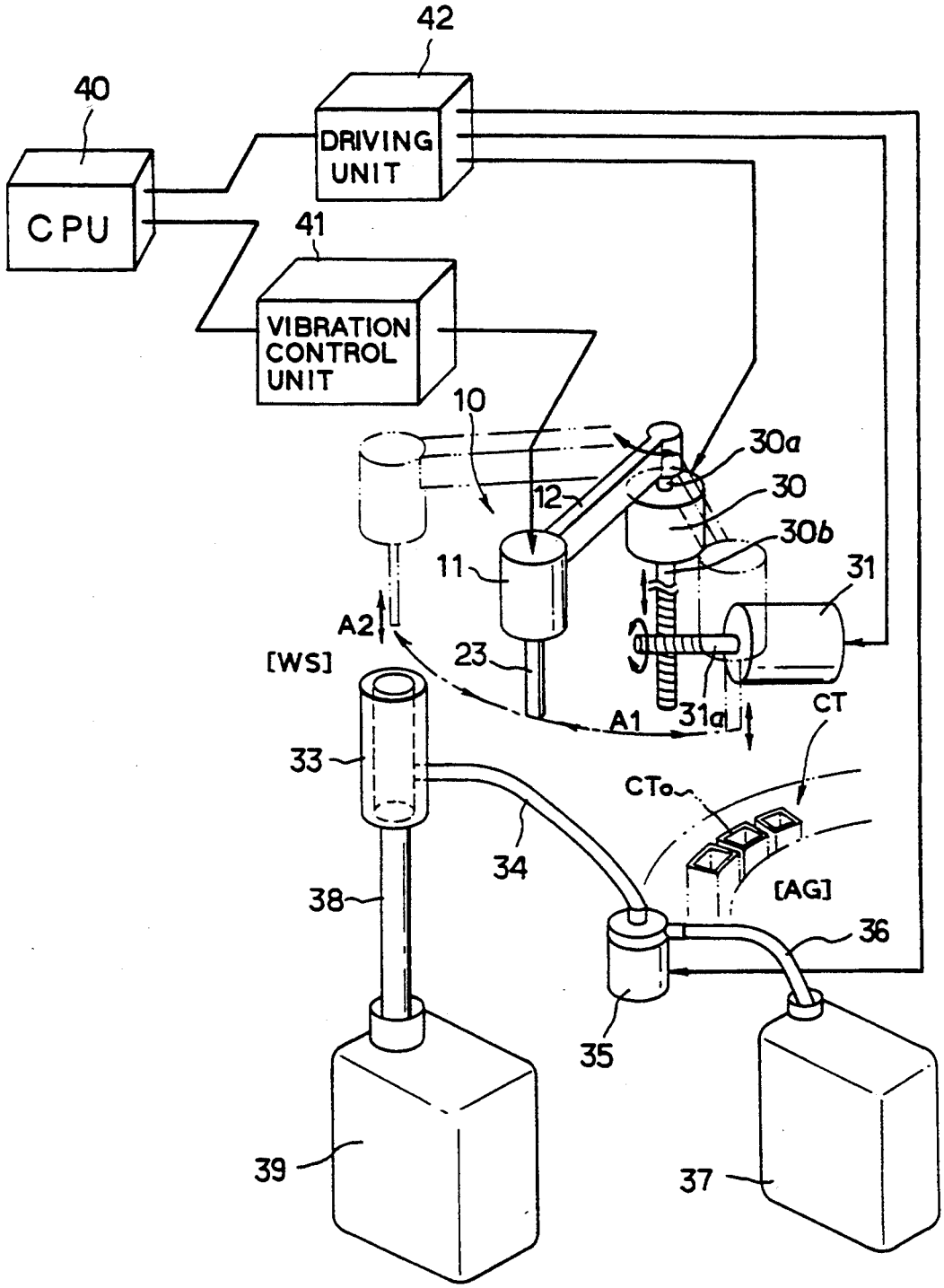
FIG. 1 is a perspective view, partially schematically, of a stirring apparatus utilized for an automatic chemical analysis system according to the present invention.

A stirring apparatus of an automatic chemical analysis system, such as shown in FIG. 10, according to one embodiment of the present invention is provided with, as shown in FIG. 1, a stirring arm member 10 which comprises a holder 11 for supporting a piezoelectric vibrator and an arm 12 connected to the holder 11 and extends therefrom in a horizontal direction.

Figure 2:
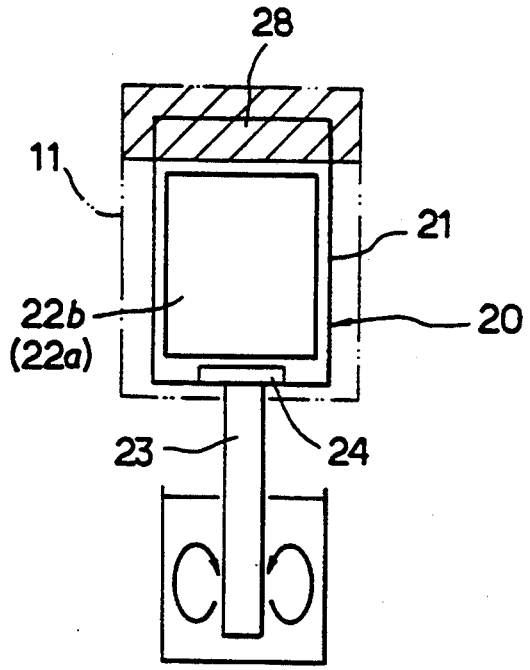
FIG. 2 is a side view of a piezoelectric vibrator forming a stirring member according to the present invention.

The holder 11 has an inner hollow structure as shown in FIG. 2, and a piezoelectric vibrator 20 is accommodated in the hollow portion of the holder 11. The piezoelectric vibrator 20 is composed of a flexible metallic plate shim 21 and piezoelectric ceramics **22*a* and 22*b* bonded to both sides of the metallic plate shim 21 so as to provide a bimorf type structure. In an alternation, the piezoelectric ceramics may be bonded to only one side of the metallic plate shim 21** to form a unimorf type piezoelectric vibrator.

Figure 3:
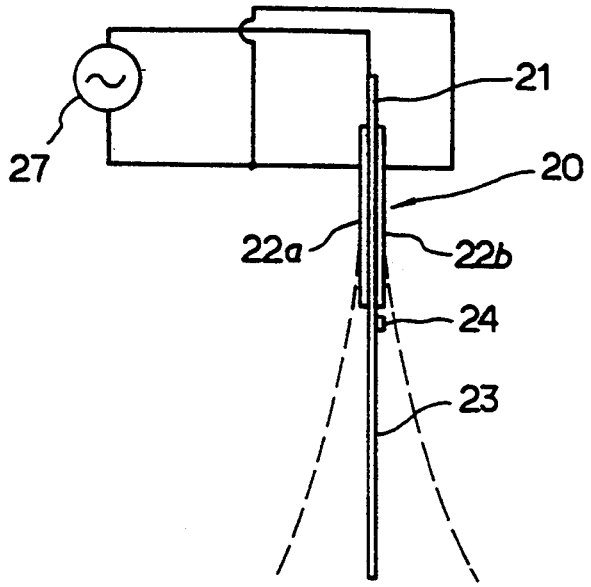
FIG. 3 is a circuit showing a vibrating condition of the piezoelectric vibrator.

When an A.C. voltage is applied to the bimorf type piezoelectric vibrator 20 of the structure described above from a power source 27 as shown in FIG. 3, the piezoelectric ceramics **22*a* and 22*b* are alternatingly expanded and contracted and the metallic plate shim 21 is vibrated in a direction normal to the surface thereof, this direction being called vibrating direction hereafter. The shim 21 has one end secured to a fixing member 28 and another end extended to form a stirring member 23 (blade member) in shape of elongated strip or plate. The another extended end portion forming the stirring member 23 may be formed of the same material as that of the shim 21. The stirring member 23 is vibrated together with the shim 21 in the same vibrating direction as that of the shim 21, thus performing the stirring function in a reaction vessel. A weight 24 for adjusting the weight of the vibrating member is mounted to the lower end portion of the metallic plate shim 21**.

Figure 5:
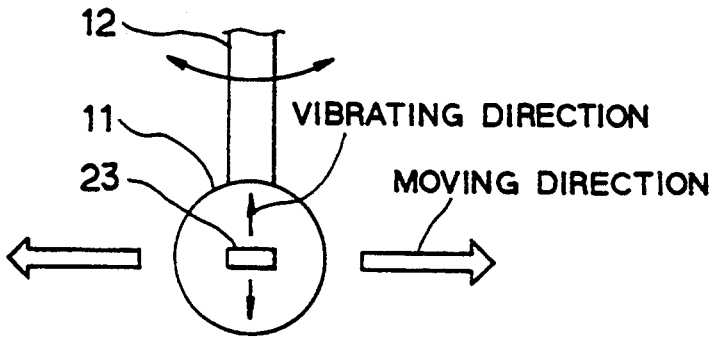
FIG. 5 is an illustration viewed from the bottom of a holder of the stirring apparatus for showing vibrating and moving directions of the stirring member of the present embodiment.

The orientation or positioning of the stirring member 23 is determined so that the vibrating direction of the stirring member 23 is normal to the moving direction or tangential direction thereof as shown in FIG. 5. That is, the width direction of the stirring member is parallel to the moving direction or tangential direction thereof.

As shown in FIG. 1, the arm 12 has one end connected to the holder 11 and another end is secured to an upper portion of a rotation shaft **30*a* of an electric motor 30 for moving the arm member 10 in the horizontal direction. The motor 30, that is, the rotation shaft 30*a*, is vertically arranged as shown in FIG. 1 and when the rotation shaft 30*a* is rotated, the arm 12, that is, the holder 11** is rotated arcuately in a horizontal plane as shown by arrows A1 between a stirring member washing position WS and a stirring position AG in reaction vessels CT arranged in a row in the manner described hereinbelow.

The mortor 30 also has a shaft portion **30*b*, at its vertical lower side, which is formed with a gear to which a gear formed to a rotation shaft 31a of another motor 31, arranged horizontally, is engaged so as to form a worm gear mechanism. According to this structure, when one 31 of the motors is driven, the other one 30 of the motors is also rotated through the gear engagement of the shaft portion 30*b* of the motor 30 and the rotation shaft 31*a* of the motor 31, whereby the holder 11** is moved in the vertical direction as shown by an arrow A2.

To the stirring member washing position WS of the stirring apparatus is arranged a washing pool 33 having an opening directed upward, and a washing liquid supply pump 35 is connected to the washing pool 33 through a tube 34. The washing liquid supply pump 35 is also connected to a washing liquid tank 37 through a tube 36. According to this arrangement, when the pump 35 is driven, the liquid in the tank 37 is sucked up and drained in the washing pool 33, which has a drain port formed to the bottom of the washing pool 33, and the drain port is communicated with a disposal liquid tank 39 through a tube 38 to store the used washing liquid in the disposal liquid tank 39.

The stirring apparatus according to this embodiment is further equipped with a central processing unit (CPU) 40 for controlling the whole operation of the apparatus including the stirring and washing treatments, a vibration controller 41 and a driving unit 42 both managed by the CPU 40. The CPU 40 performs the controlling operations as shown in a flowchart of FIG. 4. The vibration controller 41 supplies an A.C. voltage with a predetermined frequency to the piezoelectric vibrator 20 when agitating command instructions are generated from the CPU 40. The driving unit 42 is equipped with three driving circuits for driving the electric motors 30 and 31 and the washing liquid supply pump 35, and the respective circuits generate driving signals therefrom to members or units to be driven upon the reception of instructions from the CPU 40.

Figure 4:
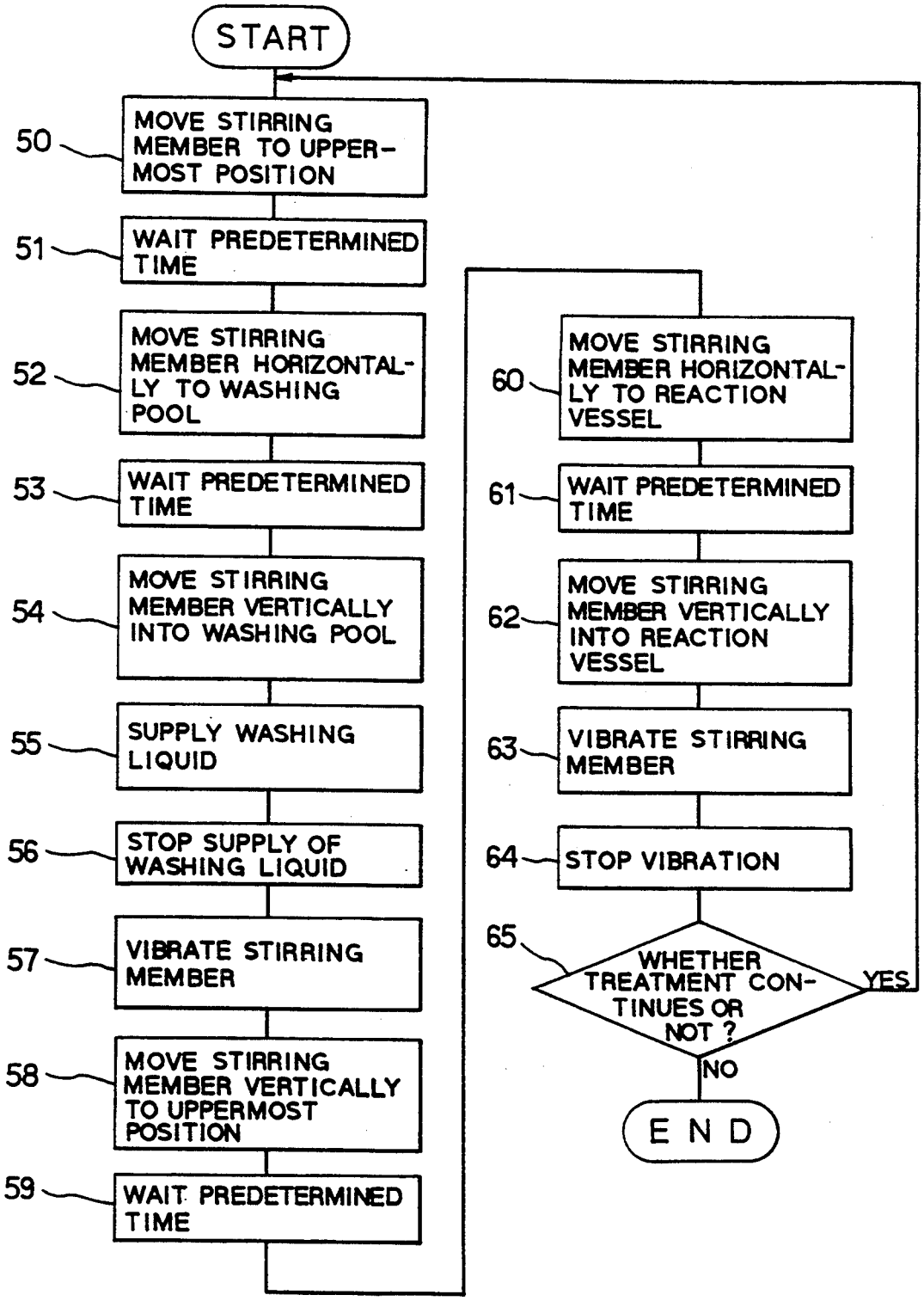
FIG. 4 is a flowchart showing stirring and washing processes.

The operations of the stirring and washing processes executed by the CPU 40 are described hereunder with reference to the flowchart of FIG. 4.

First, in Step 50, the CPU 40 generates instructions to move or transfer the stirring member 23 to the uppermost position of its vertical movement. That is, the CPU 40 gives the instructions to the driving unit 42 to drive the motor 31 for performing the vertical movement, and according to this vertical movement of the motor 31, the motor 30 for performing the horizontal movement is moved upward, thus also moving upwards the holder 11 and the stirring member 23 to its uppermost position. In the next Step 51, the movement of the vibrating member 23 for the next treatment is stopped at a preliminarily stored predetermined time, for example, by 0.3 sec. Namely, the stirring member 23 does not immediately move in the horizontal direction for the next treatment and is kept as it is for the predetermined time.

After the completion of Step 51, in Step 52, the CPU 40 generates instructions for horizontally moving the stirring member 23 to the washing position WS. According to the instructions, the driving unit 42 rotates the motor 30 for the horizontal movement in a predetermined direction to thereby rotate the holder 11 together with the stirring member 23 to its uppermost position directly above the washing position WS. After the rotation thereof, the following treatment for lowering the stirring member 23 is not immediately executed as instructed in Step 53 and kept as is for the predetermined time.

After the passing of the predetermined time, in Step 54, the driving unit 42 is driven to rotate the motor 31 to thereby directly lower the stirring member 23 to a predetermined position in the washing pool 33. In the next Step 55, the washing liquid is supplied by the instructions from the CPU 40 through the driving unit 42 for performing washing operation for a predetermined time. According to this step, the driving unit 42 drives the pump 35 to drain the washing liquid stored in the washing liquid tank 35 into the washing liquid pool 33, whereby the stirring member 23 starts the stirring of the washing liquid in the pool 33. After the draining of the washing liquid in the pool 33 for the predetermined time, the supplying of the washing liquid is stopped and then the washing step is completed in Step 56.

Figure 9:
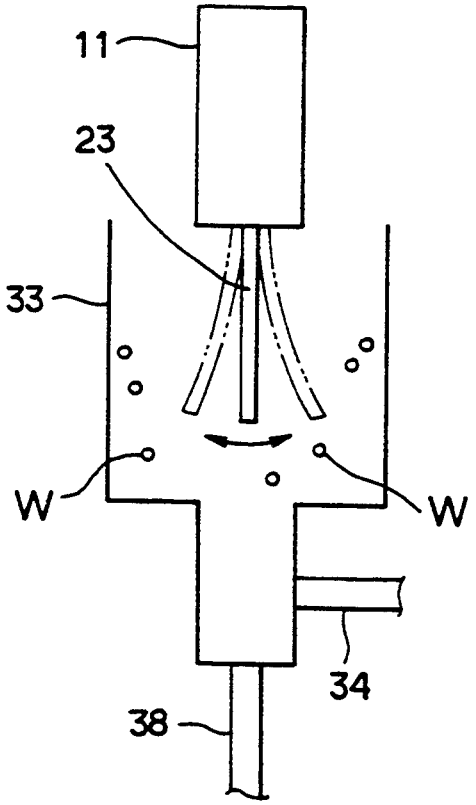
FIG. 9 is a view for explantion of the shaking-off of the washing liquid after the washing of the stirring member.

In Step 57, with the stirring member 23 remaining in the pool 33, the CPU 40 generates instructions to the vibration controller 41 to vibrate the stirring member 23 in the pool 33, whereby the piezoelectric vibrator 20 is oscillated and the metallic plate shim 21, i.e. stirring member 23, is vibrated with suitable frequency, thus the washing liquid adhering to the stirring member 23 being forcibly shaken off as shown in FIG. 9. In the present embodiment, the frequency suitable for this shaking-off of the drops of the washing liquid is predetermined through experiments, which is preliminarily stored in a memory of the vibration controller 41. As this frequency, the same as or different from the frequency for stirring will be adapted.

After the shaking-off of the washing liquid, Step 58 will be executed, in which the CPU 40 drives the driving unit 42 to lift up the stirring member 23 to the uppermost position at the washing position WS. In Step 59, the stirring member 23 is not moved and is kept as is for the predetermined time without immediately moving horizontally. The stirring member 23 is vibrated during the upward movement in the pool space and at the waiting position above the pool. After the completion of this waiting time, Step 60 is executed in which the CPU 40 drives the driving unit 42 to rotate the stirring member 23 horizontally to the washing position WS to the stirring position AG. After this horizontal rotation movement, in Step 61, the stirring member 23 is stopped and kept as it is for the predetermined time without being immediately transferred to the next step.

In the next Step 62, the motor 30 for driving vertically the stirring member 23 is driven and the stirring member 23 is lowered into a reaction vessel $CT_0$ at the stirring position AG at this moment. Next, in Step 63, the CPU 40 gives stirring instructions to the vibration controller 41, and accordingly, the vibration controller 41 oscillates the piezoelectric vibrator 20 with the frequency preliminarily set for the stirring. According to this oscillation, the stirring member 23 is vibrated in the vibrating direction with the predetermined stirring frequency, whereby the sample and the reagent in the reaction vessel $CT_0$ are stirred and mixed uniformly.

After the elaspe of the constant time from the starting of the stirring, the vibration of the piezoelectric vibrator 20 is stopped and then the stirring is also completed. In the succeeding Step 65, it is determined whether or not the stirring should be continued in accordance with command information or sequence information from an operator of the CPU 40, and in the determination of the continuation of the stirring, the operation returns to the Step 50, and on the contrary, in the event of determination of no continuation of the stirring, the stirring step is completed.

In the present embodiment, the holder 11 constitutes a holding mechanism of the present invention, and the vibration controller 41 and the piezoelectric vibrator 20 in the Steps 63 and 64 of FIG. 4 constitute the stirring member vibrating mechanism of the present invention. The driving unit 42, the pump 35, the tubes 34, 36 and the tank 37 in the Steps 55 and 56 of FIG. 4 constitute the washing mechanism of the present invention. Furthermore, the driving unit 42, the motors 30, 31 and the arm 12 in the Steps 50–54 and 58–62 of FIG. 4 constitute the moving or transferring mechanism. The means in the Steps 51, 53, 59 and 61 constitute waiting time setting means incorporated in the moving mechanism. The vibration controller 41 and the piezoelectric vibrator 20 in the Step 57 constitute the vibrating mechanism after the washing operation.

According to the structure of the stirring apparatus and the treatments performed thereby according to the present invention, the following advantageous functions and effects can be attained.

Figures 6A, 6B, 6C:
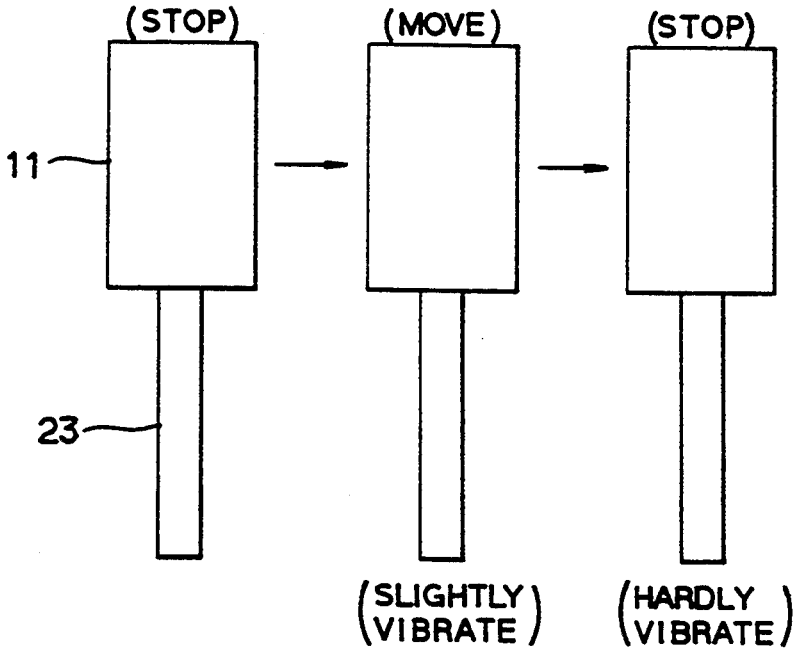
FIGS. 6A to 6C are views showing vibrating conditions of the stirring member of the present embodiment during its movement.

When the stirring member 23 is moved or transferred horizontally between the washing position WS and the stirring position AG, since the width direction and the horizontally moving direction of the stirring member 23 are in accordance with each other as shown in FIG. 5, the stirring member 23 vibrates very much less. Namely, even if the stirring member 23 is moved horizontally from the stopped state as shown in FIG. 6A, the vibration during the horizontal movement is minute because of high rigidity in the width direction of the stirring member 23 and, hence, the stirring member 23 hardly vibrates if it is stopped as shown in FIGS. 6B and 6C.

Figure 7:
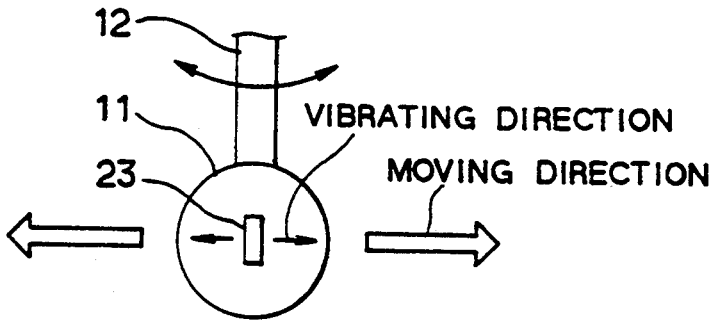
FIG. 7 (PRIOR ART)
FIG. 7 is an illustration viewed from the bottom of a holder of the stirring apparatus for showing vibrating and moving directions of the stirring member of the conventional structure.
Figures 8A, 8B, 8C:
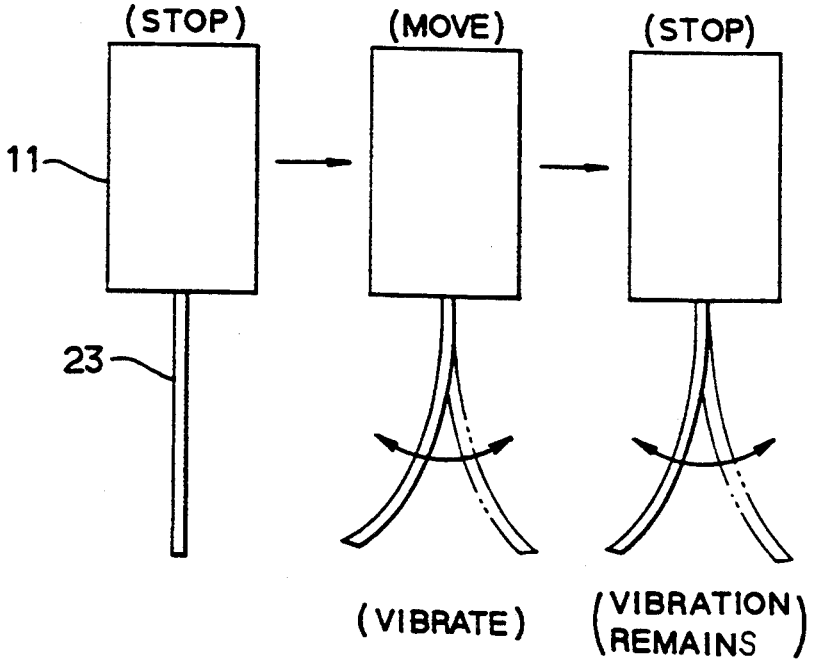
FIG. 8A (PRIOR ART) FIG. 8B (PRIOR ART) FIG. 8C (PRIOR ART)
FIGS. 8A to 8C are views showing vibrating conditions of the stirring member of the conventional structure during its movement.

With respect to the above advantage according to the present invention, the problem mentioned hereinbefore in the prior art is described with reference to FIGS. 7 and 8. Referring to FIG. 7, when the vibrating direction and the moving direction of the stirring member 23 accord with each other, it greatly vibrates during its movement and, after stopping the movement thereof, a large vibration remains for a time being as shown in FIGS. 8A to 8C, thus causing the problem.

In the present embodiment, such vibration caused during the horizontal movement of the stirring member can be effectively suppressed and, in addition, even in the moving direction change from the horizontal direction to the vertical direction, since the waiting time under the stopped movement condition is set, the vibration can be surely settled even if small vibrations are caused in both the directions. Accordingly, the stirring member never collides with the edge portion of the reaction vessel when the stirring member is lowered therein, thus improving the durability and the reliability of the stirring member and the entire stirring apparatus. Furthermore, because of less vibration during the movement, the splashing of washing liquid adhering to the stirring member 23 can be substantially prevented.

Still furthermore, as shown in FIG. 9, the washing liquid drops W are shaken off forcibly in the washing pool 33, the splashing thereof during the movement can be also prevented and thus the measurement of the sample can be surely and exactly performed without being diluted by the adhering solution.

Since the vibration of the stirring member 23 of the present embodiment includes the perpendicular component, the vertical vibrating function can be effectively performed in the reaction vessel, thus reducing the stirring time, and moreover, the bubbling and air-involving can be suppressed, so that leaking of the reaction liquid and splashing thereof can be substantially eliminated, thus being advantageous.

It is to be noted that the stirring member of the present invention is not limited to the structure described above and other stirring members, each in shape of elongated strip or plate vibrating in its thickness direction, may be utilized.

What is claimed is:

1. A stirring apparatus for an automatic chemical analysis system for analyzing a sample in a reaction vessel for obtaining an amount of a specific component of the sample, the automatic chemical analysis system including a stirring apparatus for stirring the sample with a reagent in the reaction vessel, the stirring apparatus comprising:

a stirring member having a flexible structure;

a support for holding the stirring member suspended perpendicularly therefrom;

a moving mechanism for moving the support together with the stirring member between a reaction vessel and a washing pool for washing the stirring member;

a washing mechanism including the washing pool for washing the stirring member;

a vibrating mechanism for vibrating the stirring member in the washing pool and in the reaction vessel and;

a control mechanism operatively connected to said stirring means, said moving mechanism, said washing mechanism and said vibrating mechanism, respectively, for controlling operations thereof, wherein said stirring member has a width direction parallel to a moving direction of the stirring member moved by the moving mechanism, said stirring member comprises a piezoelectric vibrator having one of an elongated strip and a plate member having surfaces, and the vibrating means vibrates the stirring member in a direction perpendicular to the surfaces of the stirring member.

2. A stirring apparatus according to claim 1, wherein said support comprises a cylindrical holder having an inner hollow portion in which the piezoelectric vibrator is accommodated.

3. A stirring apparatus according to claim 2, wherein the piezoelectric vibrator comprises a flexible metallic shim and a piezoelectric ceramic bonded to a surface of the metallic shim.

4. A stirring apparatus according to claim 1, wherein said stirring member has a width direction parallel to a tangential direction of the stirring member when moved circularly.

5. A stirring apparatus for an automatic chemical analysis system for analyzing a sample in a reaction vessel for obtaining an amount of a specific component of the sample, the automatic chemical analysis system including a stirring apparatus for stirring the sample with a reagent in the reaction vessel, the stirring apparatus comprising:

a stirring member having a flexible structure;

a support for holding the stirring member suspended perpendicularly therefrom;

a moving mechanism for moving the support together with the stirring member between a reaction vessel and a washing pool for washing the stirring member;

a washing mechanism including the washing pool for washing the stirring member;

a vibrating mechanism for vibrating the stirring member in the washing pool and in the reaction vessel and;

a control mechanism operatively connected to said support, said moving mechanism, said washing mechanism and said vibrating mechanism, respectively, for controlling operations thereof, wherein said stirring member has a width direction parallel to a moving direction of the stirring member moved by the moving mechanism, said stirring member comprises a piezoelectric vibrator having one of an elongated strip and a plate member having surfaces, and the vibrating means vibrates the stirring member in a direction perpendicular to the surfaces of the stirring member in a direction perpendicular to the surface of the stirring member, and wherein said moving mechanism includes a first drive mechanism for moving vertically the stirring member and a second drive mechanism for moving horizontally the stirring member which is vibrated during movement in an atmosphere by the vibrating means for removing a washing liquid adhering to the stirring member during the washing thereof, and said moving mechanism further includes a waiting time setting mechanism for setting a predetermined waiting time at one of at a point in time when and a point in time immediately prior to when the stirring member changes movement from a horizontal movement to a vertical movement.

6. A stirring apparatus according to claim 5, wherein said support comprises a cylindrical holder having an inner hollow portion in which the piezoelectric vibrator is accommodated.

7. A stirring apparatus according to claim 6, wherein the piezoelectric vibrator comprises a flexible metallic shim and a piezoelectric ceramic bonded to a surface of the metallic shim.

* * * * *